United States Patent [19]

Yoon

[11] Patent Number: 5,049,853

[45] Date of Patent: Sep. 17, 1991

[54] ELECTRIC HORN WITH SOLID STATE DRIVER

[75] Inventor: Young S. Yoon, Brighton, Mo.

[73] Assignee: Sparton Corporation, Jackson, Mich.

[21] Appl. No.: 431,696

[22] Filed: Nov. 3, 1989

Related U.S. Application Data

[63] Continuation of Ser. No. 109,778, Oct. 19, 1987, abandoned.

[51] Int. Cl.[5] ..... G08B 3/10

[52] U.S. Cl. ..... 340/388; 340/384 E

[58] Field of Search ..... 340/384 E, 384 R, 388; 331/172, 173, 154; 116/142 R

[56] References Cited

U.S. PATENT DOCUMENTS

| | | | |
|---|---|---|---|
| Re. 28,745 | 3/1976 | Smith | 340/384 E |
| 3,447,151 | 5/1969 | Potter | 340/384 R |
| 3,846,792 | 11/1974 | Haigh | 340/384 E |
| 3,872,470 | 3/1975 | Hoerz et al. | 340/384 E |
| 4,100,543 | 7/1978 | Stockdale et al. | 340/384 E X |
| 4,195,284 | 3/1980 | Hampshire et al. | 340/384 E |
| 4,275,388 | 6/1981 | Hornung | 340/384 E |
| 4,361,952 | 12/1982 | Neese | 116/142 R X |
| 4,482,888 | 11/1984 | Todaka et al. | 340/384 E |
| 4,488,145 | 12/1984 | Katsuma et al. | 340/384 E |
| 4,499,453 | 2/1985 | Right | 340/384 E X |
| 4,684,927 | 8/1987 | Zofan et al. | 340/384 E |
| 4,700,177 | 10/1987 | Nakashima et al. | 340/388 |

*Primary Examiner*—Joseph A. Orsino
*Assistant Examiner*—Brian R. Tumm
*Attorney, Agent, or Firm*—Reising, Ethington, Barnard, Perry & Milton

[57] ABSTRACT

An electric horn having a diaphragm connected to a ferromagnetic plunger is driven by an electromagnetic coil to cause vibrations of the diaphragm at the resonant frequency of the diaphragm and plunger combination. A solid state driver has a timer tuned essentially to the frequency of the diaphragm assembly and controls the driver power output to effect coil energization to drive the diaphragm movement synchronously with the timer frequency. The driver output stage comprises a power MOSFET or a Darlington pair.

8 Claims, 1 Drawing Sheet

ELECTRIC HORN WITH SOLID STATE DRIVER

This application is a continuation of application Ser. No. 109,778, filed Oct. 19, 1987, now abandoned.

FIELD OF THE INVENTION

This invention relates to an electric horn with a solid state driver and particularly to such a horn with coupling at resonant frequency between the electrical and the mechanical systems.

BACKGROUND OF THE INVENTION

Electric horns as commonly used on automotive vehicles have traditionally used a vibrating diaphragm driven by an electromagnetic device. Current pulses are developed by a mechanical switch responsive to diaphragm movement such that the switch, being normally closed, would energize a magnetic coil to cause diaphragm movement in one direction against its spring bias and the movement would open the switch allowing the diaphragm return in the other direction thus closing the switch and causing the cycle to repeat. The life of such horns is limited by the life of the mechanical switch used in the horn. It is therefore desirable to devise an alternative to the mechanical switch, however requirements of high power, immunity to high voltage spikes caused by switching an inductive load, and mechanical ruggedness places severe limits on the technology that may be successfully employed.

It has been proposed in the U. S. Patent to Haigh 3,846,792 to use an electronic driver to supply short current pulses to an electric sound-producing device. In that driver an oscillator is used to provide a series of pulses to an electromagnet which attracts a ferromagnetic diaphragm. The pulses have a repetition rate substantially less than the natural frequency (3000 Hz) of the diaphragm. For each pulse, the electromagnet attracts and then releases the diaphragm to allow it to vibrate through a number of cycles before applying another pulse. A feedback circuit responsive to diaphragm position slaves the pulse timing to the diaphragm frequency to assure efficient coupling. This arrangement is adapted to high frequency horns which have small diaphragm movement and readily continue to vibrate when input pulses are removed, and does not apply to low frequency (400–500 Hz) horns. The diaphragms of the low frequency horns do not sustain ringing long after the input pulse is removed. Moreover, the feedback circuit of Haigh is ineffective to accurately time the pulse to the diaphragm movement at low frequency.

To obtain efficiency of operation of a horn, it is necessary to couple the electrical energy into the mechanical part of the system in a manner which makes best use of that energy already imparted to the diaphragm assembly. In the case of a low frequency horn, the synchronism of input pulses and diaphragm movement is of paramount importance in obtaining the highest sound energy output for a given electrical power input. The prior proposal does not provide a solution to attaining that end.

SUMMARY OF THE INVENTION

It is therefore an object of the invention to provide a horn with an electronic driver for inputting energy into the horn in each cycle in timed relation with the natural movement of the horn diaphragm.

The invention is carried out by an electric horn comprising; a closed housing having a diaphragm mounted thereon, a driving coil mounted within the housing, a ferromagnetic plunger secured to the center of the diaphragm and extending into the coil for transmitting vibrating motion to the diaphragm upon coil energization, the plunger and diaphragm having a resonant frequency, and means for energizing the coil including a solid state circuit having a timer for outputting a square wave pulse train to the coil, means for adjusting the timer substantially to the resonant frequency, a first stage driver coupled to the timer output, and a second stage driver comprising a power semiconductor switch device coupled to the coil for driving the horn at the timer frequency.

DESCRIPTION OF THE DRAWINGS

The above and other advantages of the invention will become more apparent from the following description taken in conjunction with the accompanying drawings wherein like references refer to like parts and wherein.

BEST MODE FOR CARRYING OUT THE INVENTION

Figure 1:
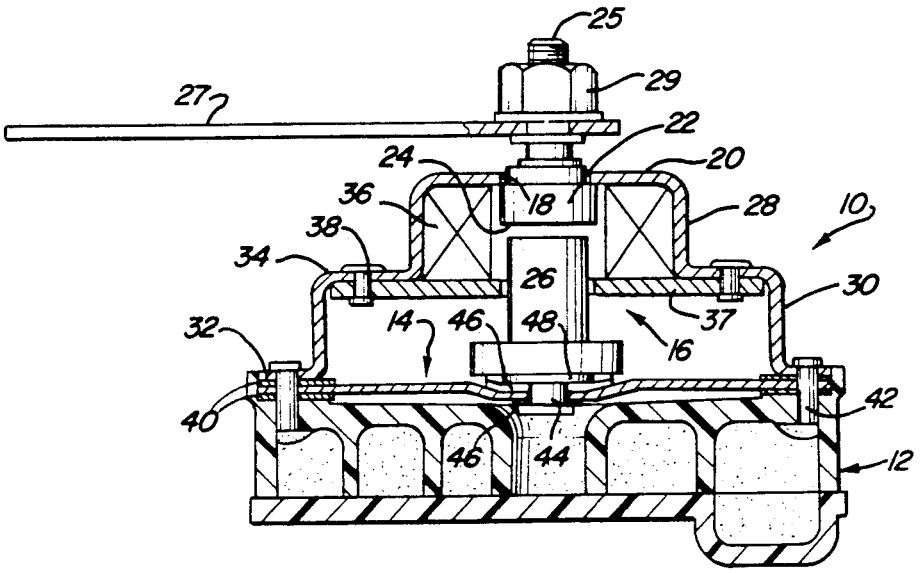
Fig-1 PRIOR ART
FIG. 1 is a cross-section view of an electric horn according to the invention.

Referring to FIG. 1, an electric horn has a sheet metal housing 10 secured to a plastic projector 12. A spring steel diaphragm 14 is trapped at its margins between the housing 10 and projector 12 and is attached at its center to a ferromagnetic plunger 16. An aperture 18 in an end wall 20 of the housing 10 holds a pole piece 22 which extends toward the plunger 16. An end face 24 of the pole piece 22 is spaced from an end face 26 of the plunger 16 by a small gap. The opposite end 25 of the pole piece 22 is threaded to receive a mounting bracket 27 and a securing nut 29.

The housing 10 is stepped to define a small end portion 28 including the end wall 20, and a larger portion 30 terminating in a radial flange 32 for supporting the diaphragm. An intermediate generally planar annular portion 34 interconnects the small end portion 28 and the larger portion 30. An electromagnetic coil 36 fits within the small end portion 28 and surrounds adjacent ends of the plunger 16 and pole piece 22. An annular mounting plate 37 secured to the intermediate portion 34 by rivets 38 retains the coil in the end portion 28. The plate 37 is apertured to accommodate the plunger 16 for free movement therein.

Regarding the mounting of the diaphragm, annular gaskets 40 conforming to the diaphragm margin are seated on either side of the diaphragm. The projector presses the gaskets 40 and diaphragm 14 against the flange 32 and fasteners 42 secure the assembly. The plunger 16 has a stem 44 of small diameter protruding through the diaphragm at its center and through a washer 46 on each side of the diaphragm. The stem defines a shoulder 48 on the plunger to engage one washer and the end of the stem 44 is upset to engage the other washer 46, thereby securing the diaphragm and the plunger for movement as a unit. The combined mass of the diaphragm 14 and the plunger 16 along with the spring rate of the diaphragm determine the resonant frequency of the diaphragm assembly. The resultant sound is amplified by the projector 12 which is tuned to the resonant frequency of the plunger/diaphragm assembly.

The mechanical aspect of the horn is described in further detail in U.S. Pat. No. 4,361,952 issued to James Neese, which is incorporated herein by reference. The chief difference between that patent and the present disclosure is the arrangement for applying electrical pulses to the coil for driving the diaphragm at its resonant frequency. In U.S. Pat. No. 4,361,952, mechanical contacts within the horn housing operated by movement of the plunger open and close the circuit to the coil. In this invention, a solid state switching circuit supplies the pulsed current to the coil.

Figure 2:
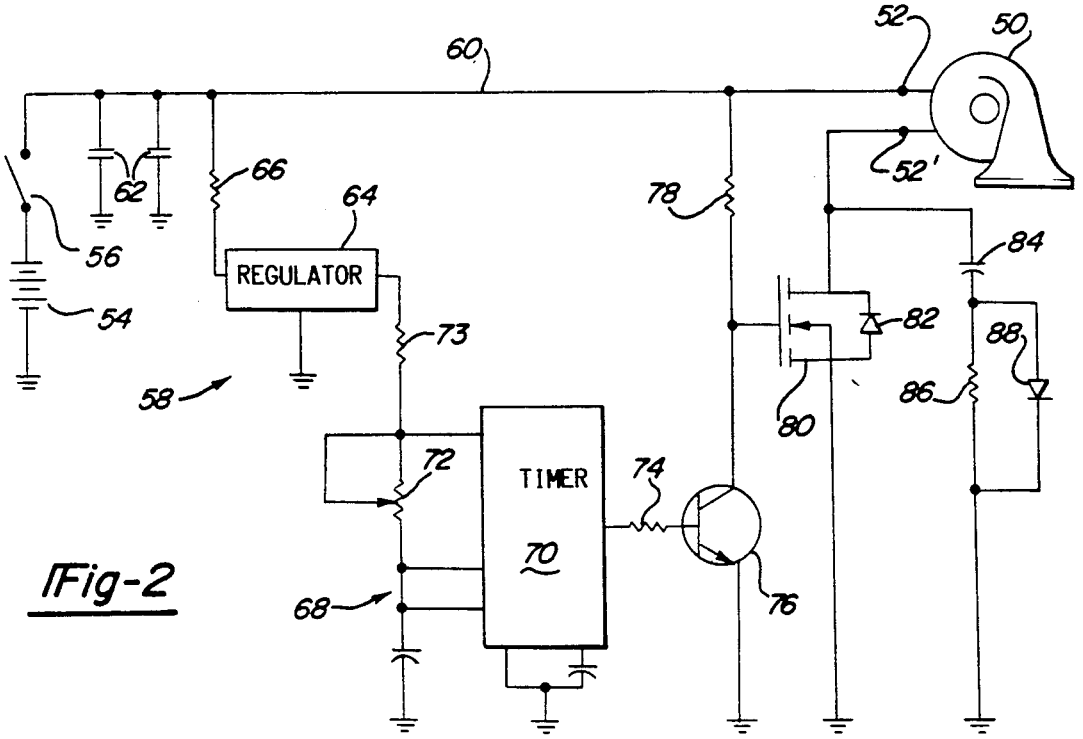
FIG. 2 is a schematic diagram of a solid state horn driver circuit according to the invention.

Referring to FIG. 2, the horn 50 has terminals 52, 52' connected to the coil. A battery or other power source 54 is coupled to the horn terminals 52, 52' through a switch 56 and a driver circuit 58. The switch 56, when closed, connects the battery 54 to the positive line 60 which directly couples to one of the horn terminals 52. The other terminal 52' is intermittently connected to ground through the driver circuit 58.

The driver circuit 58 has a pair of capacitors 62 between the line 60 and ground to suppress EMI and RFI transient spikes. A voltage regulator 64 coupled to the line 60 through a current limiting resistor 66 supplies suitable voltage to an oscillator circuit 68 which employs a 555 timer 70. The timer has several terminals connected in a well known oscillator configuration to the regulator 64 and to ground through various resistors and capacitors. In particular, an adjustable resistor 72 is used to adjust the timer output frequency as well as the duty cycle. The values of a fixed resistor 73 and the adjustable resistor 72 are selected to determine the basic frequency and the duty cycle with some fine adjustment allowed by resistor 72. The output of the oscillator circuit 68 is coupled through a resistor 74 to the base of a transistor 76 serving as the first stage of a power driver. The transistor 76 emitter is connected to ground and the collector is connected through a current limiting resistor 78 to the positive line 60. The collector is also connected to the gate of a power MOSFET 80 which serves as the driver output stage. An internal diode 82 across the source and drain of the MOSFET 80 offers transient protection. In addition, a capacitor 84 and a snubber circuit in series with the capacitor 84 comprising a resistor 86 in parallel with a diode 88 suppress a transient spike generated as the horn coil initially charges up. The source of the MOSFET 80 is connected to the horn terminal 52' to allow pulsed current flow through the coil 36 when the driver circuit 58 switches on.

The driver circuit as described above is tailored for use with a 12 volt horn having a frequency of about 400 Hz but applies to high frequency horns as well. To obtain optimum efficiency in horn operation (i.e., the highest sound level output for a given current input) the driver frequency should, within narrow limits, match the resonant frequency of the diaphragm assembly. The frequency of the driver circuit 58 is precisely adjusted to the desired horn frequency during manufacture by adjustment of the timer resistor 72 which may be a laser trimmed or otherwise adjustable resistor. The diaphragm will be driven at that rate. Small resonant frequency differences between the mechanical and electrical systems are tolerated at the expense of some reduction of sound level.

Voltages higher than 12 volts require small modifications in the driver circuit. For horns rated for use at 24, 36, or 48 Volts a Darlington pair is used in place of the power MOSFET 80. A different value for the timing resistor 72 is used for each voltage rating to adjust the duty cycle of the current pulse to the coil. While it is preferred to operate the 12 volt horns with a 60% duty cycle current, the duty cycle is progressively greater for higher voltages, approaching 90% at 48 volts. The 36 and 48 volt horns require an extra voltage regulator between the resistor 66 and the regulator 64. With the extra regulator, a power source 54 up to 125 volts may be used. The regulators prevent variations in timer frequency as a result of power supply voltage variations.

In operation, upon closing of the switch 56, the timer 70 will issue a train of pulses at the resonance frequency of the diaphragm 14 activating the first and second stages 76 and 80 of the driver circuit 58 to send a train of power pulses at the same frequency to the coil 36. The resulting magnetic impulse causes the plunger 16 and diaphragm 14 to move synchronously with the power pulses so that energy is added to the diaphragm system in the most harmonious and efficient manner. Even if the power pulses were just slightly off the peak of the resonance adequate coupling can be accomplished. In the 12 volt system a tolerance of + or − 10 Hz is permitted, the sound output being reduced by 3 or 4 decibels. In the 24 to 48 volt systems the tolerance is + or − 25 Hz since the more powerful pulse input can overcome the phase disparity between the electrical and the mechanical system.

The basic driver circuit 58, with the exceptions noted above is useful for horns of each voltage rating. The circuit provides a square wave output to the coil which is especially desirable since positive horn actuation is accomplished consistently at the initiation of each current pulse whereas sine wave or saw tooth waves increase gradually and are effective for coil energization only when they overcome transients in the coil resulting from the previous cycle. The resulting predictable response allows a particular sound quality to be produced consistently for each horn design.

It will thus be seen that the present invention provides a horn switching arrangement yielding longer horn life, precise calibration, universal application to various horn models, and precise switching for improved quality sound. The invention applies to high and low horn frequencies and allows maximum sound output by energizing the coil in each cycle for a time determined by adjusting the duty cycle. Although the invention is described herein as applied to a projector type horn, it is also useful with a resonator type horn.

What is claimed is:

1. A vehicle horn for an automotive vehicle having a vehicle battery with a voltage rating of twelve volts or greater, said horn comprising:

a closed housing having a diaphragm mounted on the housing with its periphery clamped thereto and forming a substantially closed chamber, a driving coil mounted within said chamber, a ferromagnetic plunger coupled to the center of said diaphragm and extending into said coil for imparting motion to the diaphragm upon energizations, said diaphragm suspending said plunger for reciprocating motion relative to said coil and having a spring characteristic whereby the coupled diaphragm and plunger have a resonant frequency of mechanical vibration of about four hundred hertz, a solid state drive circuit coupled between said battery and said coil for energizing said coil, said driver circuit generating a DC pulse train having a pulse repetition rate substantially equal to said resonant frequency and having a duty cycle of sixty percent or greater whereby said diaphragm vibrates at substantially said resonant frequency and generates sound waves at substantially said resonant frequency.

2. The invention as defined in claim 1 wherein said solid state driver circuit generates a pulse train of substantially square wave pulses.

3. The invention as defined in claim 1 wherein said solid state driver circuit includes means for adjusting the pulse repetition rate of said pulse train.

4. The invention as defined in claim 1 wherein the pulse repetition rate of said pulse train is within about fifteen hertz of said resonant frequency.

5. The invention as defined in claim 1 wherein said solid state driver circuit comprises a timer for outputting said DC pulse train in the form of a square wave pulse train, a first stage driver coupled to the timer output, a second stage driver comprising a power semiconductor switch coupled with the output of said first stage driver and having its ouput coupled to said coil.

6. The invention as defined in claim 5 wherein the power semiconductor switch is a power MOSFET device.

7. The invention as defined in claim 5 including a variable resistor coupled to the timer for adjusting the timer frequency.

8. A vehicle horn for an automotive vehicle having a vehicle battery with a voltage rating of twelve volts or greater, said horn comprising:

a closed housing having a diaphragm mounted on the housing with its periphery clamped thereto and forming a substantially closed chamber, a driving coil mounted within said chamber, a ferromagnetic plunger coupled to the center of said diaphragm and extending into said coil for imparting motion to the diaphragm upon energization, said diaphragm suspending said plunger for reciprocating motion relative to said coil and having a spring characteristic whereby the coupled diaphragm and plunger have a resonant frequency of mechanical vibration of about four hundred hertz, a solid state driver circuit mounted externally of said chamber and coupled between said battery and said coil for energizing said coil, said driver circuit generating a DC pulse train having a pulse repetition rate substantially equal to said resonant frequency whereby said diaphragm vibrates at substantially said resonant frequency and generates sound waves at substantially said resonant frequency.

* * * * *